United States Patent [19]

Fujioka et al.

[11] 4,063,935

[45] * Dec. 20, 1977

[54] OXIDATION-RESISTING AUSTENITIC STAINLESS STEEL

[75] Inventors: Tokio Fujioka; Masayuki Kinugasa; Shozo Iizumi; Shizuhiro Teshima; Isamu Shimizu, all of Shin-Nanyo, Japan

[73] Assignee: Nisshin Steel Co., Ltd., Japan

[ * ] Notice: The portion of the term of this patent subsequent to Nov. 2, 1993, has been disclaimed.

[21] Appl. No.: 679,601

[22] Filed: Apr. 23, 1976

Related U.S. Application Data

[63] Continuation-in-part of Ser. No. 529,766, Dec. 4, 1974, abandoned.

[30] Foreign Application Priority Data

Dec. 22, 1973 Japan ..... 48-142976
Dec. 22, 1973 Japan ..... 48-142977

[51] Int. Cl.[2] ..... C22C 38/34; C22C 38/40

[52] U.S. Cl. ..... 75/128 C; 75/122; 75/128 E

[58] Field of Search ..... 75/128 C, 128 E, 122

[56] References Cited

U.S. PATENT DOCUMENTS

| | | | |
|---|---|---|---|
| 2,553,330 | 5/1951 | Post et al. | 75/128 E |
| 2,687,954 | 8/1954 | Lohr | 75/128 E |
| 3,729,308 | 4/1973 | Eiselstein et al. | 75/128 E |
| 3,900,316 | 8/1975 | Jones | 75/128 C |
| 3,929,520 | 12/1975 | Hellner | 75/128 C |
| 3,989,514 | 11/1976 | Fujioka et al. | 75/128 E |

FOREIGN PATENT DOCUMENTS

| | | | |
|---|---|---|---|
| 46-32328 | 9/1971 | Japan | 75/128 E |
| 46-32330 | 9/1971 | Japan | 75/128 E |
| 46-39581 | 11/1971 | Japan | 75/128 C |

*Primary Examiner*—Arthur J. Steiner
*Attorney, Agent, or Firm*—Ladas, Parry, Von Gehr, Goldsmith & Deschamps

[57] ABSTRACT

An austenitic stainless steel substantially comprising not more than 0.15% by weight of C, 2.56 – 4.0% by weight of Si, not more than 2.0% by weight of Mn, 8 – 22% by weight of Ni, 16 – 25% by weight of Cr, 0.001 – 0.05% by weight of at least one alkaline earth metal, 0 – 2.5% by weight of Al, 0 – 0.1% by weight of at least one rare earth metal, 0 – 1.0% by weight of at least one of Nb, Ta, Ti, Zr and Hf, 0 – 2.0% by weight of Cu and balance Fe is disclosed. This class of steels are superior to the known high Si oxidation-resisting austenitic stainless steels in oxidation resistance especially in resistance to scaling, are of the same level in high temperature strength, and are much less expensive.

3 Claims, 3 Drawing Figures

OXIDATION-RESISTING AUSTENITIC STAINLESS STEEL

CROSS REFERENCE TO THE COPENDING APPLICATION

This is a continuation-in-part application of the application of Ser. No. 529,766 filed Dec. 4, 1974, now abandoned.

BACKGROUND OF THE INVENTION

This invention relates to a class of austenitic stainless steels provided with high resistance against oxidation at high temperatures especially when they undergo cyclic heating to high temperatures in oxidative atomosphere.

Recently in every country, as one of the measures for prevention of atmospheric pollution, regulations on control of automobile exhaust gases have become more and more severe. In order to comply with such regulations, various methods and means are being searched for. The immediate necessity is development of a complete system for purifying auto exhaust gases of the conventional internal combustion engines. As the means therefor, thermal reactor, after-burner, catalytic converter, etc. have been developed and they are used singly or in combination. These apparatuses are exposed to hot burning gases and are cyclically heated to high temperatures over 1100° C, often 1200° C or higher. So, the materials for these apparatuses must have high resistance to oxidation and corrosion at high temperatures and resistance to scaling as well as high temperature strength.

Typical materials that have been considered to be suitable for those apparatuses are ferritic Fe-Cr-Al alloys such as JIS (Japanese Industrial Standard) FCH-1 (25Cr-5Al), JIS FCH-2 (19Cr-3Al), etc. and austenitic stainless steels such as Type 310 steels, etc. These materials are appreciated because of their high temperature characteristics, workability and low cost. However, the ferritic alloys are remarkably inferior to the austenitic stainless steels in high temperature strength and are easily deformed when subjected to cyclic heating, and are inferior in weldability and workability, too, although they have good resistance to oxidation scaling and gas corrosion because of formation of protective film of alumina. The austenitic stainless steels have good high temperature strength, but they are inferior to the ferritic alloys in high temperature oxidation resistance and scaling resistance. Especially Type 310 steels retain austenitic structure even in the welded state, and therefore easily suffer hot cracking in welding. Further they are considerably expensive and cannot be used freely.

As the stainless steels with good high temperature oxidation resistance, high silicon heat-resisting austenitic stainless steels are known as AISI 302B (18Cr-9Ni-2.5Si), AISI 314 (25Cr-20Ni-2Si), DIN 4828 (20Cr-12Ni-2Si), etc. These steels have excellent oxidation resistance at temperatures of 1000° C to 1100° C, but are easily oxidized at temperatures over 1100° C and oxide scales easily spall and peel off. In order to improve properties of these steels, addition of rare earth metals such as Y, Ce, La etc. has been tried, but has not brought about satisfactory results.

It was known that combined addition of Si and Al or Si, Al and Ca gives good oxidation resistance to steels of these types. For instance, in U.S. Pat. No. 3,729,308, a class of stainless steels containing up to about 0.25% C, 0.3% - 1.5% Si, up to 2% Mn, 15 - 23% Ni, 17 - 23% Cr, up to 0.5% Al, up to 0.05 Ce and up to 0.5% Ti is disclosed. (Percentages are all by weight.) In U.S. Pat. No. 3,837,846, a class of steels or rather super alloys containing 0.01 - 0.10% C, about 0.5% Si, an effective amount of Mn, 15 - 45% Ni, 16 - 35% Cr, 0.001 - 0.008% Ca, 0.1 - 1.5% Al, and others is disclosed. In Japanese Patent Application Publication No. 32328/71, a class of steel containing 0.05 - 0.4% C, 0.2 - 2% Si, 0.5 - 5% Mn, 8 - 25% Ni, 14 - 30% Cr, 0.003 - 0.5% Ca is disclosed. In Japanese Patent Application Publication No. 32330/71, a class of steels containing 0.05 - 0.4% C, 0.2 - 2% Si, 0.5 - 5% Mn, 8 - 25% Ni, 14 - 30% Cr, 0.003 - 0.5% Ca, and 0.003 - 0.5% Mg is disclosed. All these steels contain Si in an amount not exceeding 2%, and all of them are still inferior in scaling resistance at temperatures over 1100° C.

Similar steels are disclosed in U.S. Pat. No. 2,553,330, which does not teach anything about high temperature scaling resistance, especially scaling resistance when the steel is cyclicly heated to temperatures over 1100° C.

U.S. Pat. No. 2,687,954 discloses Incolloy 800 type alloys containing 0.01 - 1.0% Al, 0.001 - 0.20% Ca, up to 0.50% rare earth metal, which may further contain up to 0.25% C, 0.20 - 3.0% Si and 0.02 - 4.0% Mn. It is well known that alloys of this type is very susceptible to high temperature cracking, especially when their Si content is high. So the alloys of this type is neither workable nor weldable. And they are very expensive materials. We ourselves found that combined addition of Si and Al or Si, Al and rare earth metals gives rather inexpensive stainless steel materials which are provided with good high temperature strength comparable with that of Type 310 steels and that are superior thereto in oxidation resistance and scaling resistance, too. (Japanese Patent Application No. 93354/73 (Laying-Open Publication No. 46509/75) and Japanese Patent Application No. 106948/73 (Laying-Open Publication No. 57913/75) )

In the course of the study, we now have found that combined incorporation of 2.56 - 4.0% of Si and a small amount of an alkali earth metal such as Ca in the austenitic stainless steel greatly improves oxidation and scaling resistance retaining high temperatures strength and workaability of said steel. Also, it has been learned that single or combined addition of Al, at least one rare earth metal such as Y, La, Ce, etc. and at least one element selected from the class consisting of Nb, Ta, Ti, Zr, and Hf in addition to an alkaline earth metal further improves the high temperature properties of said steel and we have created this invention.

Prior to our finding, austenitic stainless steels containing more than 2.5% Si and Ca more not known. Because it was well known that austenitic steels containing such a high level of Si were highly susceptible to high temperature cracking and could not be welded.

SUMMARY OF THE INVENTION

According to this invention, a class of novel stainless steels comprising not more than 0.15% by weight of C, 2.56 - 4.0% by weight of Si, not more than 2.0% by weight of Mn, 8 - 22% by weight of Ni, 16 - 25% by weight of Cr, 0.001 - 0.05% by weight of at least one alkaline earth metal, 0 - 2.5% by weight of Al, 0 - 0.1% by weight of at least one of rare earth metals, 0 - 1.0% by weight of at least one of Nb, Ta, Ti, Zr and Hf, and balance Fe is provided. In some cases not more than 2% by weight of Cu is added, too.

These stainless steels have higher oxidation resistance than the Type 310 steels and are far lower priced than they. The steels of this invention exhibit excellent scaling resistance at temperatures over 1100° C.

In this class of steels:

Carbon (C) is an austenite former and takes an important role for providing the steel with high temperature strength. However, too high content of this element makes hot and cold working difficult. So the content must be not more than 0.15%, preferably not more than 0.12%, and more preferably not more than 0.1%.

Silicon (Si) is important for improving high temperature oxidation resistance, and at least 2.56% is required to exhibit good scaling resistance at temperatures over 1100° C in the combination with the other addition elements, especially Ca. If the content thereof exceeds 4.0%, however, oxidation resistance is not improved in proportion to the increase, and formation of a large amount of delta-ferrite in ingot-making is induced, which markedly impairs hot workability. Therefore, the Si content must be not more than 4.0%, it is preferably 3.0 - 4.0% and more preferably 3.4% - 4.0%.

Manganese (Mn) is also an austenite former and the addition thereof contributes to saving of Ni. But this element impairs oxidation resistance of the steels. Therefore, this element should not be contained in high content, and is contained in the steels of this invention in the amount normally found in the ordinary stainless steels, that is, not more than 2.0%. The preferred Mn content is not more than 1.5% and the more preferred content thereof is not more than 1.0%.

Nickel (Ni) is one of the fundamental elements of austenitic stainless steels. In order to maintain austenitic structure in combination with Si, and Al, too, at least 8% is necessary. Increase in Ni content allows increase of Cr, Si and Al content. But Ni content is limited to 22% from the economic view point. The preferred Ni content is 10 - 22%, and the more preferred Ni content is 12 - 20%.

Chromium (Cr) is the most important element for maintaining oxidation resistance at high temperatures. At least 16% is required to obtain satisfactory properties. When the content thereof exceeds 25%, in the presence of Si, and Al, too, a large amount of Ni is required to prevent formation of delta-ferrite. Therefore the reasonable content of Cr is 16 - 25%, the preferred content range is 16 - 23%, the more preferred content range is 16 - 22%.

Alkaline earth metal is the most important element together with Si in order to give the steels excellent oxidation resistance. As the alkaline earth metal, Mg, Ca, Sr and Ba can be used, although usually Ca is used. Addition of a slight amount of Ca remarkably improves oxidation resistance of the steels by forming homogeneous inside oxide layer which adheres well to the substrate and prevents growth of scale. For this purpose, at least 0.001% of Ca is required. And more than 0.05% of Ca is not easily dissolved in the steel. The preferred content range is 0.001 - 0.035% and more preferably 0.001 - 0.02%.

Aluminum (Al) plays an important role to improve oxidation resistance in the steels of this invention. Addition of Al in combination with Si, Ca, and a slight amount of rare earth metals if desired, markedly improves oxidation resistance. At least 0.1% of Al is required for this purpose, but addition of more than 2.5% of Al requires addition of an additionl amount of Ni to balance the composition and impairs ductility of the material. The preferred range of Al content is 0.3 - 2.0% and the more preferred range is 0.3 - 1.5%.

The austenitic steels as those of this invention, the composition of which is designed so that a small amount of ferrite phase is formed in order to prevent hot cracking in welding, are liable to suffer cracking in hot working since a slight amount of ferrite phase is formed in ingot. Addition of a slight amount of rare earth metals remarkably improves hot workability. Also addition of rare earth metals in the austenitic steels such as those of this invention which contain high percentage Si and a slight amount of Ca enhances the effect of Ca and thus improves high temperature oxidation resistance. (Addition of rare earth metals only does not contribute to improvement of oxidation resistance.) For the purpose of the above-mentioned improvement of hot workability and oxidation resistance, at least 0.001% of at least one rare earth metal should be added. If more than 0.1% thereof is added, hot workability and oxidation resistance are not proportionally improved and rare earth metals are costly materials. So the upper limit of the content is 0.1%. The preferred content range is 0.005 - 0.1% and the more preferred content range is 0.005 - 0.08%.

Titanium (Ti), zirconium (Zr), hafnium (Hf), niobium (Nb) and tantalum (Ta) form stable carbides and nitrides and are effective to enhance high temperature strength of the steels. These elements are equivalent in the composition of the steels of this invention. These elements inhibit formation of AlN and thus keep Al in solid solution. In order to exhibit this effect, at least one of these elements must be added in an amount of at least 0.05%. But addition of more than 1.0% of these elements spoils oxidation resistance of the steels. The preferred range is 0.05 - 0.7% and the more preferred range is 0.05 - 0.5%.

Copper (Cu) is an austenite former, too. Addition thereof saves use of Ni. But addition of a large amount of Cu promotes grain boundary brittleness and impairs the hot workability and makes the material sensitive to hot cracking. The maximum allowable content is 2.0%. The preferred range is up to 1.5% and the more preferred range is up to 1.0%.

Of course the steels of this invention inevitably contain incidental impurities. Of such impurities, sulfur (S) must not exist in excess of 0.04%. The content must preferably be not more than 0.03% and more preferably not more than 0.02%. Phosphorus (P) must not be present in excess of 0.05%, preferably it must be not more than 0.04%, more preferably not more than 0.035%.

The austenitic stainless steels of this invention are provided with highly improved high temperature strength and resistance to oxidation and scaling surpassing those of Type 310, and that can be offered at much lower prices.

BRIEF DESCRIPTION OF THE DRAWINGS

Now the invention is explained in detail in reference to the attached drawings.

DETAILED DESCRIPTION OF THE INVENTION

Figure 1:
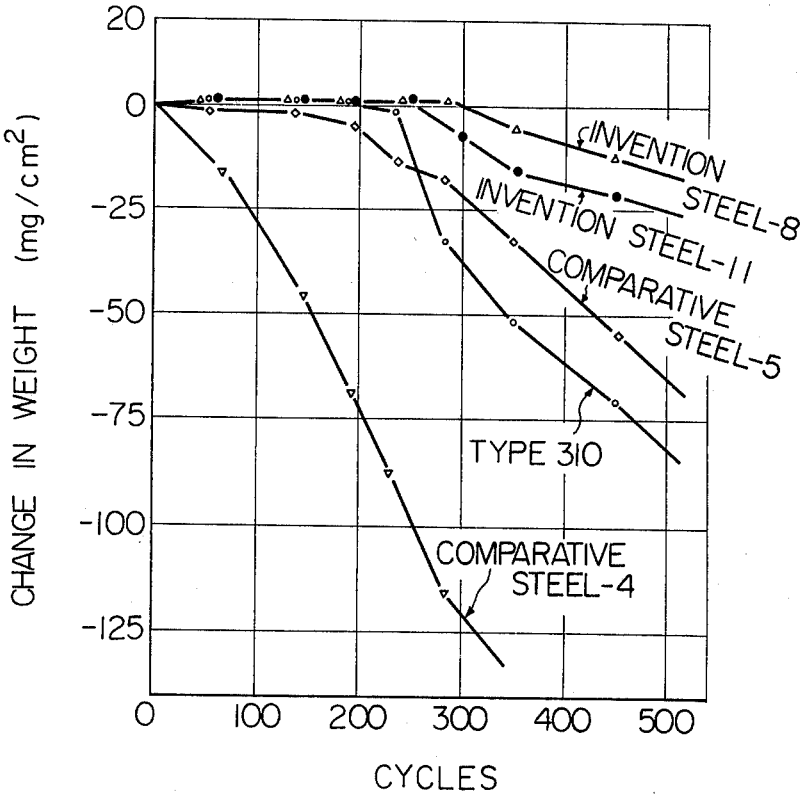
FIG. 1 is a diagram showing oxidation weight gain and oxidation weight loss in samples of the steels of this invention (called Invention Steels hereinafter), comparative steel samples, and a commercially available similar steel when they undergo cyclic heating (heating at 1100° C for 25 minutes and air-cooling for 5 minutes).

The invention is further illustrated by way of examples and comparative examples.

Sample heats within the scope of this invention, sample heats of comparative compositions and a sample heat of a Type 310 steel were prepared and shaped into specimen as follows.

Mild steel scrap was melted together with ferrochromium, ferro-nickel, etc. and was decarbonized in an Heroult type arc furnace. Calcium and rare earth metals were added in the tapping stage in the form of calcium-silicon and rare earth-calcium-silicon and/or mixed rare earth metals such as Mischmetal. The effective use rate was about 10% for Ca, and 20 - 40% for rare earth elements.

In the large scale production, the steel of this invention can be produced by the vacuum oxygen decarbonization process or the argon oxygen decarbonization process using a converter. In any process, calcium and rare earth metals are added in the last tapping stage.

The molten steel was poured into ingot cases to obtain 7-ton ingots. The ingots were soaked and were made into slabs by means of a slab-forming mill. The formed slabs were subjected to the surface grinding, and were heated in a slab furnace at 1150° - 1260° C for 5 hours, and were made into hot coils by hot rolling. The hot coils were annealed and pickeled, and then cold-rolled to 2 mm thickness. The coldrolled sheet was finally annealed at 1010° - 1150° C for 1 - 5 minutes and quenched.

Test specimens for tensile test were cut out of the thus obtained sheet. They were 2 mm in thickness, 12.5 mm in width and 50 mm in gauge length with enlarged end portions. Creep rupture test specimens were made from the slabs which had been heated at 1010° - 1150° C for about 1 hour and was quenched. The creep rupture test specimens were 6 mm in diameter and 30 mm in gauge length with enlarged end portions 12.5 mm in diameter.

The chemical analyses of these steel samples are summarized in Table 1.

Table 1

| | Sample No. | C | Si | Mn | Ni | Cr | Ca | Al | R.E.* | Others |
|---|---|---|---|---|---|---|---|---|---|---|
| Comparative Steels | 1 | 0.045 | 3.13 | 0.70 | 12.89 | 18.59 | — | — | — | Nb 0.2 |
| | 2 | 0.069 | 3.30 | 0.80 | 13.41 | 18.11 | — | — | 0.020 | — |
| | 3 | 0.070 | 3.62 | 0.77 | 12.96 | 18.33 | — | — | 0.031 | Cu 1.57 |
| | 4 | 0.072 | 2.71 | 1.59 | 12.68 | 18.16 | — | 0.005 | — | Nb 0.21 |
| | 5 | 0.063 | 2.52 | 0.80 | 14.13 | 19.15 | — | 1.02 | — | — |
| | 6 | 0.061 | 3.20 | 0.85 | 15.24 | 18.87 | — | 0.86 | — | Nb 0.24 |
| Invention Steels | 1 | 0.070 | 2.56 | 0.83 | 13.20 | 18.61 | 0.0059 | — | — | — |
| | 2 | 0.057 | 3.71 | 0.78 | 13.27 | 18.54 | 0.0076 | — | — | Nb 0.15, Zr 0.04 |
| | 3 | 0.052 | 2.73 | 0.64 | 12.90 | 18.35 | 0.0066 | — | 0.003 | — |
| | 4 | 0.060 | 3.93 | 0.83 | 13.27 | 18.01 | 0.0037 | — | 0.014 | — |
| | 5 | 0.054 | 3.60 | 0.87 | 13.14 | 18.93 | 0.0039 | — | 0.010 | Ti 0.22, Zr 0.05 |
| | 6 | 0.054 | 3.64 | 0.57 | 12.40 | 17.90 | 0.0082 | — | 0.002 | Nb 0.20, Cu 1.48 |
| | 7 | 0.059 | 3.74 | 0.87 | 14.74 | 18.10 | 0.0054 | 0.56 | — | — |
| | 8 | 0.065 | 3.47 | 0.55 | 14.95 | 18.61 | 0.0064 | 0.90 | 0.008 | — |
| | 9 | 0.058 | 3.09 | 0.59 | 14.77 | 18.32 | 0.0037 | 0.86 | 0.014 | — |
| | 10 | 0.067 | 3.40 | 0.84 | 15.16 | 19.00 | 0.0039 | 1.00 | 0.006 | Ti 0.21, Zr 0.13 |
| | 11 | 0.052 | 3.57 | 0.85 | 14.76 | 18.45 | 0.0066 | 0.42 | 0.030 | Nb 0.15, Ti 0.11 |
| Type 310 | | 0.07 | 0.79 | 1.58 | 19.50 | 24.85 | — | 0.003 | — | — |

*Total amount of rare earth metals

All these specimens were subjected to an oxidation test of exposing them to the temperature of 1200° C in the atmosphere for 100 hours. Oxidation weight gain and oxidation weight loss of the specimens in this test are indicated in mg/cm$^2$ unit in Table 2. Oxidation weight loss was determined by weighing the specimens after removing the oxide scale by blasting glass beads onto the surface thereof.

Comparative Steels 1 and 4 are simple high Si austenitic steels containing none of Al, Ca and rare earth metals (in Comparative Steel 4, the Al content does not reach a significant amount.) Comparative Steels 2 and 3 contain rare earth metals in addition to high Si. Comparative Steels 5 and 6 contain Al in addition to high Si.

Comparative Steels 2 and 3 are somewhat superior to Comparative Steel 1 in oxidation weight gain, and Comparative Steel 5 and 6 are superior to Comparative Steels 1 and 4 in both oxidation weight gain and oxidation weight loss.

Invention Steels 1 to 6 which contain Ca and optionally rare earth metals and/or any of Ti, Zr. Hf, Nb and Ta are superior to Comparative Steels 1 and 4 in oxidation weight gain and loss. Invention Steels 7 through 11, which contain Al, Ca and optionally rare earth metals and/or any of Ti, Zr, Hf, Nb and Ta, are further superior to Invention Steels 1 through 6. All the Invention Steels are far superior to the known Type 310 commercial steel, which exhibits the most excellent oxidation resistance among the austenitic stainless steels.

In order to test and compare the steels of this invention, comparative steels and the commercially available similar steel, under more practical conditions, specimens of Table 2

| Sample No. | | Oxidation weight gain (mg/cm²) 1st run | 2nd run | Average | Oxidation weight loss (mg/cm²) 1st run | 2nd run | Average |
|---|---|---|---|---|---|---|---|
| Comparison Steels | | | | | | | |
| | 1 | 15.10 | 15.74 | 15.42 | 12.76 | 14.40 | 13.58 |
| | 2 | 12.20 | 12.28 | 14.24 | 14.46 | 15.38 | 14.92 |
| | 3 | 12.85 | 12.79 | 12.82 | 16.84 | 15.72 | 16.28 |
| | 4 | 11.5 | 12.1 | 11.8 | 15.8 | 16.5 | 16.2 |
| | 5 | 8.9 | 9.0 | 9.0 | 10.5 | 10.7 | 10.6 |
| | 6 | 9.6 | 10.1 | 9.9 | 10.2 | 11.2 | 10.7 |
| Invention Steels | | | | | | | |
| | 1 | 5.62 | 5.46 | 5.54 | 9.20 | 7.14 | 9.17 |
| | 2 | 4.13 | 4.29 | 4.21 | 8.25 | 8.37 | 8.31 |
| | 3 | 4.76 | 4.53 | 4.65 | 8.42 | 8.64 | 8.53 |
| | 4 | 4.81 | 4.58 | 4.70 | 8.16 | 9.51 | 8.83 |
| | 5 | 4.66 | 4.79 | 4.72 | 8.23 | 8.68 | 8.45 |
| | 6 | 3.84 | 3.74 | 3.79 | 9.18 | 9.21 | 9.20 |
| | 7 | 3.7 | 3.7 | 3.7 | 6.8 | 6.9 | 6.9 |
| | 8 | 4.8 | 4.6 | 4.7 | 7.4 | 7.6 | 7.5 |
| | 9 | 4.5 | 4.0 | 4.3 | 8.0 | 7.2 | 7.6 |
| | 10 | 4.2 | 4.3 | 4.3 | 7.5 | 7.4 | 7.5 |
| | 11 | 2.9 | 3.2 | 3.1 | 6.8 | 6.9 | 6.9 |
| Type 310 | | 7.5 | 6.5 | 7.0 | 11.3 | 10.5 | 10.9 |

Comparative Steels 4 and 5, Invention Steels 8 and 11 and the Type 310 steel were repeatedly heated at 1100° C for 25 minutes and air-cooled for 5 minutes and change in their weight was measured. The results are shown in FIG. 1. It is obvious from FIG. 1 that the steels of this invention are far superior to the comparative steels and the commercially available similar steel in the scaling resistance.

The test results on high temperature strength of some of Invention Steels and the commercially available Type 310 steel are summarized in Table 3. The high temperature strength of Invention Steels is on nearly the same level as the known Type 310 steel. Invention Steels 2, 5 and 6, which contain some of Nb, Ta, Ti, Zr and Hf in addition to Ca (and rare earth metal), exhibit high temperature strength better than the Type 310 steel. Even Invention Steel 1, which contains only Ca as the additional element, is satisfactorily useful.

Invention Steels 10 and 11, which contain Al and some of Nb, Ta, Ti, Zr and Hf in addition to Ca and rare earth metals, exhibit high temperature strength better than the Type 310 steel. Invention Steel 7 which contains Ca and Al but none of Nb, Ta, Ti, Zr and Hf, and Invention Steel 9, which contains Ca, Al and rare earth metal and none of Nb, Ta, Ti, Zr and Hf, are practically useful, too, although they are somewhat inferior to the Type 310 steel in high temperature strength.

Figure 2:
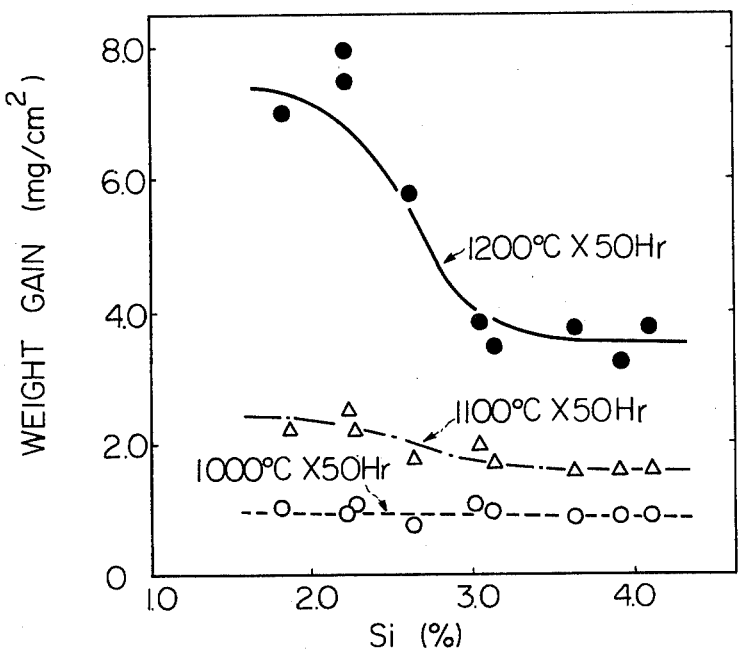
FIG. 2 shows the relation between Si contents and oxidation weight gain in the steels relating to this invention.
Figure 3:
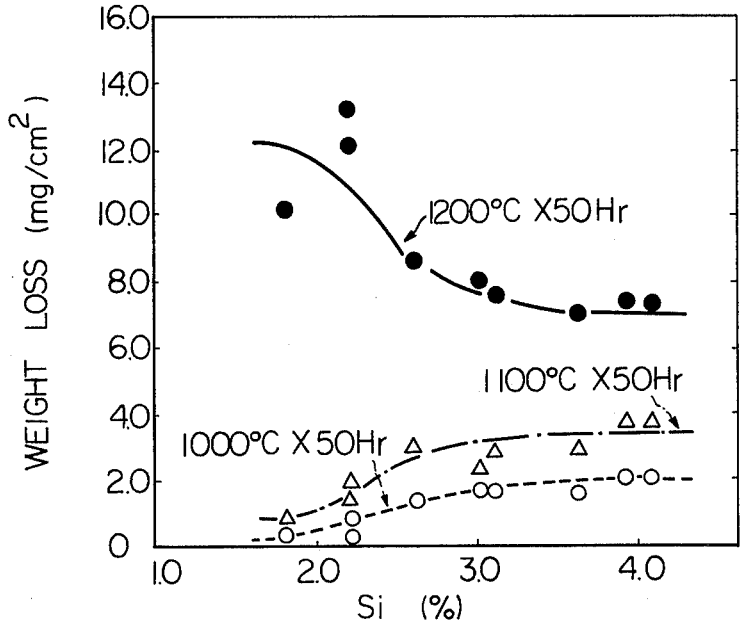
FIG. 3 shows the relation between Si contents and oxidation weight loss in the steels relating to this invention.

The relation between Si contents and scaling resistance in the steels relating to this invention when the steels are heated at 1000° C, 1100° C and 1200° C for 50 hours is shown in FIG. 2 and 3. The compositions of the steel specimens and the numerical data for FIG. 2 are given in Table 4.

Table 3

| Sample No. Invention steels | Tensile Test at 800° C: Tensile strength (Kg/mm²) | Total elongation (%) | Tensile test at 1000° C: Tensile strength (Kg/mm²) | Total elongation (%) | Creep rupture strength at 800° C: C.R.S. in 300 hrs. (Kg/mm²) | C.R.S. in 1000 hrs. (Kg/mm²) |
|---|---|---|---|---|---|---|
| 1 | 17.2 | 81 | 5.7 | 95 | 4.6 | 3.7 |
| 2 | 18.0 | 66 | 7.5 | 63 | 5.4 | 4.7 |
| 5 | 24.1 | 72 | 10.3 | 65 | 6.1 | 5.1 |
| 6 | 22.3 | 75 | 10.5 | 68 | 5.4 | 4.7 |
| 7 | 19.2 | 100 | 6.2 | 147 | 4.7 | 3.9 |
| 8 | 20.1 | 95 | 7.8 | 125 | 4.8 | 4.2 |
| 10 | 24.2 | 70 | 10.2 | 63 | 6.0 | 5.2 |
| 11 | 23.3 | 71 | 10.1 | 66 | 5.5 | 4.8 |
| Type 310 | 22.3 | 54 | 8.5 | 73 | 4.9 | 4.2 |

Table 4

| Composition (%) C | Si | Mr | Cr | Ni | R.E. | Ca | Oxidation weight gain (mg/cm²) 1000° C | 1100° C | 1200° C |
|---|---|---|---|---|---|---|---|---|---|
| 0.055 | 1.86 | 0.88 | 18.74 | 12.65 | 0.014 | 0.0021 | 0.92 | 2.10 | 1.00 |
| 0.045 | 2.24 | 0.86 | 18.17 | 9.50 | 0.016 | 0.0032 | 1.06 | 2.50 | 8.00 |
| 0.054 | 2.24 | 0.85 | 18.04 | 12.80 | 0.013 | 0.0024 | 0.87 | 2.10 | 7.50 |
| 0.077 | 2.60 | 0.79 | 17.72 | 9.41 | 0.017 | 0.0036 | 0.90 | 1.70 | 5.80 |
| 0.056 | 3.03 | 0.89 | 18.32 | 9.38 | 0.014 | 0.0028 | 0.98 | 2.00 | 3.90 |
| 0.049 | 3.09 | 0.92 | 18.12 | 12.60 | 0.025 | 0.0046 | 0.88 | 1.80 | 3.30 |
| 0.054 | 3.60 | 0.87 | 18.93 | 13.14 | 0.010 | 0.0039 | 0.78 | 1.60 | 3.80 |
| 0.060 | 3.93 | 0.83 | 18.01 | 13.27 | 0.014 | 0.0037 | 0.85 | 1.65 | 3.20 |
| 0.049 | 4.00 | 0.85 | 19.32 | 13.15 | 0.035 | 0.0096 | 0.85 | 1.60 | 3.65 |

The shape and size of the specimens were as previously explained with respect to the tensile test. The compositions of the specimens ranges from the 18Cr - 10Ni type to the 19Cr - 13Ni type. The oxidation weight loss is illustrated only in the drawing and numerical data therefor is omitted. In these drawings, black round dots represent data at 1200° C, triangle dots represent data at 1100° C and white round dots represent data at 1000° C. As seen in these drawings, both oxidation weight gain and weight loss remarkably increase at the Si content range less than about 2.6%. As stated previously, there existed no austenitic stainless steel containing more than 2.5% Si and Ca, the known austenitic stainless steels did not withstand cyclic heating to temperatures over 1100° C. But our study revealed the stainless steels become resistant to oxidation at temperatures over 1100° C by combined addition of more than 2.56% Si and a small amount of Ca, and this invention provides such steel materials. The criticality of the Si content of about 2.56% in scaling resistance is well illustrated in FIG. 2. And from Table 1 and 2, it is learned that, even though the Si content is increased to 3% or more, if the steels do not contain Ca (Comparative Steels), scaling resistance there of is still very poor. Also, it is learned that, even though the steel contains Ca, if the Si content thereof is less than 2.56% (2.60%), the scaling resistance is not satisfactory.

The invention has been described in detail with reference to some preferred embodiments thereof, but it must be understood that further modification is possible within the scope and spirit of this invention as defined in the attached claims.

What we claim is:

1. An oxidation-resisting austenitic stainless steel consisting essentially of not more than 0.15% by weight of C, 2.56 - 4.0% by weight of Si, not more than 2.0% by weight of Mn, 8 - 22% by weight of Ni, 16 - 25% by weight of Cr, 0.001 - 0.05% by weight of at least one alkaline earth metal, and balance Fe.

2. The oxidation-resisting austenitic stainless steel as set forth in claim 1, wherein the C content is not more than 0.12% by weight, the Si content is 3.0 - 4.0% by weight, the Mn content is not more than 1.5% by weight, the Ni content is 10 - 22% by weight, the Cr content is 16 - 23% by weight, the alkaline earth metal is Ca and its content is 0.001 - 0.035% by weight.

3. The oxidation-resisting austenitic stainless steel as set forth in claim 2, wherein the C content is not more than 0.1% by weight, the Si content is 3.4 - 4.0% by weight, the Mn content is not more than 1.0% by weight, the Ni content is 12 - 20% by weight, the Cr content is 16 - 22% by weight, and the Ca content is 0.001 - 0.02% by weight.

* * * * *